US005205424A

United States Patent [19]

Gaspar

[11] Patent Number: 5,205,424

[45] Date of Patent: Apr. 27, 1993

[54] CHILD RESISTANT CAP AND CONTAINER ASSEMBLAGE

[75] Inventor: Ruben C. Gaspar, St. Davids, Pa.

[73] Assignee: Merck & Co., Inc., Rahway, N.J.

[21] Appl. No.: 896,775

[22] Filed: Jun. 10, 1992

[51] Int. Cl.[5] ..... B65D 47/08; B65D 55/02; B65D 83/04

[52] U.S. Cl. ..... 215/210; 215/216; 215/235; 215/244; 215/263; 215/330; 220/282; 222/153; 222/402.11; 222/517; 222/556; 221/152

[58] Field of Search ..... 215/203, 208, 210, 216, 215/235, 236, 237, 238, 239, 240, 244, 263, 330; 220/281, 282; 222/153, 402.11, 517, 556; 221/151, 152

[56] References Cited

U.S. PATENT DOCUMENTS

| | | | |
|---|---|---|---|
| 2,179,147 | 11/1939 | Genei | 215/210 |
| 2,361,958 | 11/1944 | Nyden | 222/556 |
| 3,734,330 | 5/1973 | Danner et al. | 215/210 |
| 3,782,577 | 1/1974 | Levey | 215/208 X |
| 3,805,987 | 4/1974 | Horvath | 215/330 X |
| 3,853,250 | 12/1974 | Alpern | 222/517 |
| 4,078,687 | 3/1978 | Zapp | 215/210 |
| 4,433,789 | 2/1984 | Gibilisco . | |
| 4,653,668 | 3/1987 | Gibilisco . | |
| 4,776,501 | 10/1988 | Ostrowsky | 215/235 X |
| 4,832,218 | 5/1989 | Gibilisco . | |
| 4,962,869 | 10/1990 | Gross et al. | 222/153 |
| 4,969,584 | 11/1990 | Joulia | 222/402.11 |
| 5,022,566 | 6/1991 | Song et al. | 222/556 X |
| 5,038,964 | 8/1991 | Bouix | 222/153 |
| 5,054,662 | 10/1991 | Santagiuliana | 222/556 X |
| 5,082,130 | 1/1992 | Weinstein | 215/225 |
| 5,114,029 | 5/1992 | Gibilisco | 215/220 |
| 5,145,080 | 9/1992 | Imbery, Jr. | 215/331 |

*Primary Examiner*—Allan N. Shoap
*Assistant Examiner*—Vanessa Caretto
*Attorney, Agent, or Firm*—Salvatore C. Mitri; Charles M. Caruso

[57] ABSTRACT

There is disclosed a child resistant cap and container assemblage comprising a container and a cap member that is secured to the container so that it can not be removed without either breaking the cap member or damaging the seal that joins the cap member to the container. The cap member is provided with a nozzle having an internal locking means so that the contents of the container can not be accessed when the container is in its normal upright position. To access the contents in the container, the assemblage is titled to disengage the locking means enabling the nozzle to be opened and permitting a user to access the contents of the container using only one hand.

6 Claims, 4 Drawing Sheets

CHILD RESISTANT CAP AND CONTAINER ASSEMBLAGE

BACKGROUND OF THE INVENTION

This invention is directed toward a child resistant cap and container assemblage which is particularly suitable for pharmaceuticals provided in the form of unit doses of medication.

Typical child resistant closures for bottles and containers usually require the user to perform some preliminary manipulations before the bottle or container can be opened. For example, some closures require the user to align a mark on the cap with a mark on the bottle or container in order to remove the cap (normally, a snap off cap). Other closures require the user to squeeze or pinch the cap and simultaneously rotate it to unscrew it and remove it from the bottle or container. Still other closures require the user to exert downward pressure on the cap and simultaneously rotate it in order to unscrew it and remove it from the bottle or container.

Although such closures are effective, they require the user to use both hands and exert some effort. Many users, because of illness, manual deformation, limited manual dexterity, and the like, have difficulty in removing the closures or can not remove them at all. Such closures are typically touted as being "child resistant", "tamper proof", and the like, but observant and innovative children have been known to readily remove them.

SUMMARY OF THE INVENTION

It is now been found that these shortcomings of typical child resistant bottle and container closures are overcome by the child resistant cap and container assemblage of this invention which enables a user to access the contents of the container using only one hand with minimum manipulation and exertion. While simple and easy to use, the cap and container assemblage presents a formidable challenge to children who may attempt to remove the cap from the container or otherwise access the contents in the container. In addition, since the cap is not removed to access the container contents, it can not be dropped or lost nor will the integrity of the contents of the container be compromised by exposure to the atmosphere or contamination with foreign matter.

The child resistant cap and container assemblage of the invention generally comprises a container body, a cap member, a nozzle member hingeably secured to the cap member and a locking means within the nozzle member that prevents the nozzle member from being rotated when the container is in a normal upright position. Upon tilting the container, the locking means is displaced permitting the nozzle member to be rotated and the contents of the container to be accessed through one end of the nozzle member. The cap member is secured to the container body in such a manner that the cap member can not be removed without either breaking the cap member or damaging the seal that joins it to the container member.

Although the child resistant cap and container assemblage of the invention is suitable for a variety of products, it is particularly adaptable for use with pharmaceuticals provided in the form of unit doses of medication such as pills, capsules, tablets, caplets, and the like. Thus, while the ensuing description of the child resistant cap and container assemblage of the invention will contain reference to unit doses of medication, it should be understood that such reference is used to illustrate the invention and is not intended to be, nor should it be construed as being, limitative of the invention.

DETAILED DESCRIPTION OF THE INVENTION

The child resistant cap and container assemblage of the invention will become more apparent from the ensuing description when considered together with the accompanying drawing wherein like reference numerals denote like parts and wherein.

Figure 1:
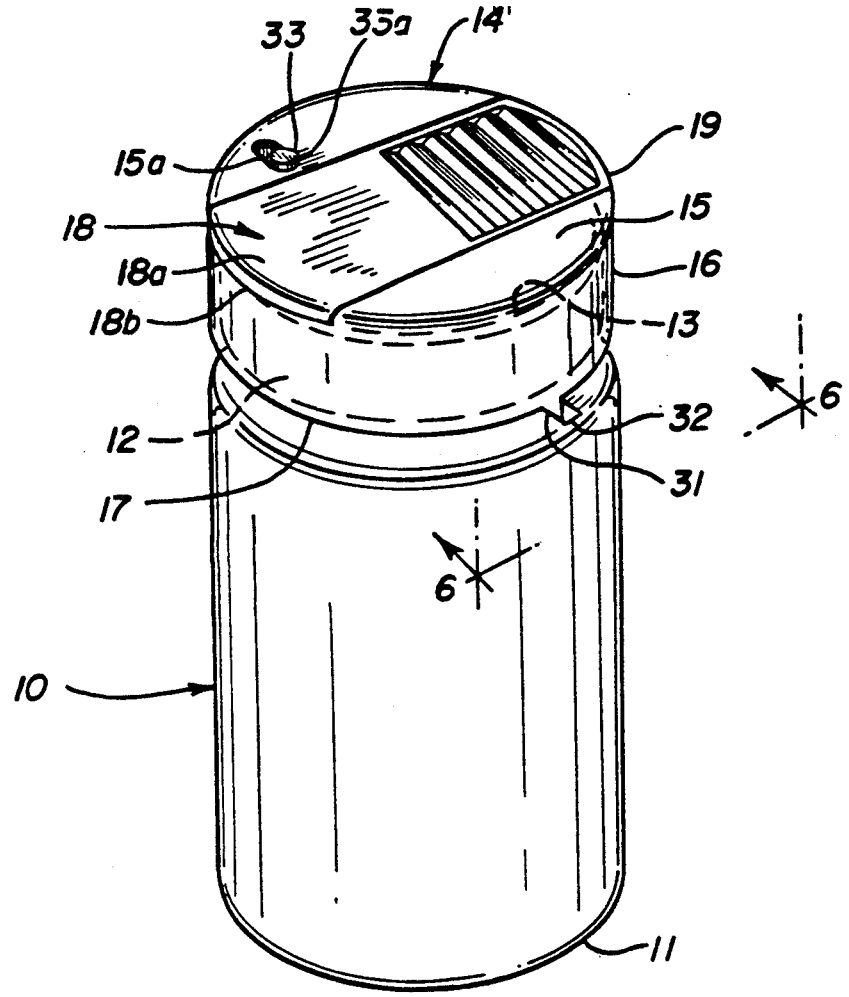
FIG. 1 is a perspective view of the child resistant assemblage cap and container assemblage of the invention.
Figure 2:
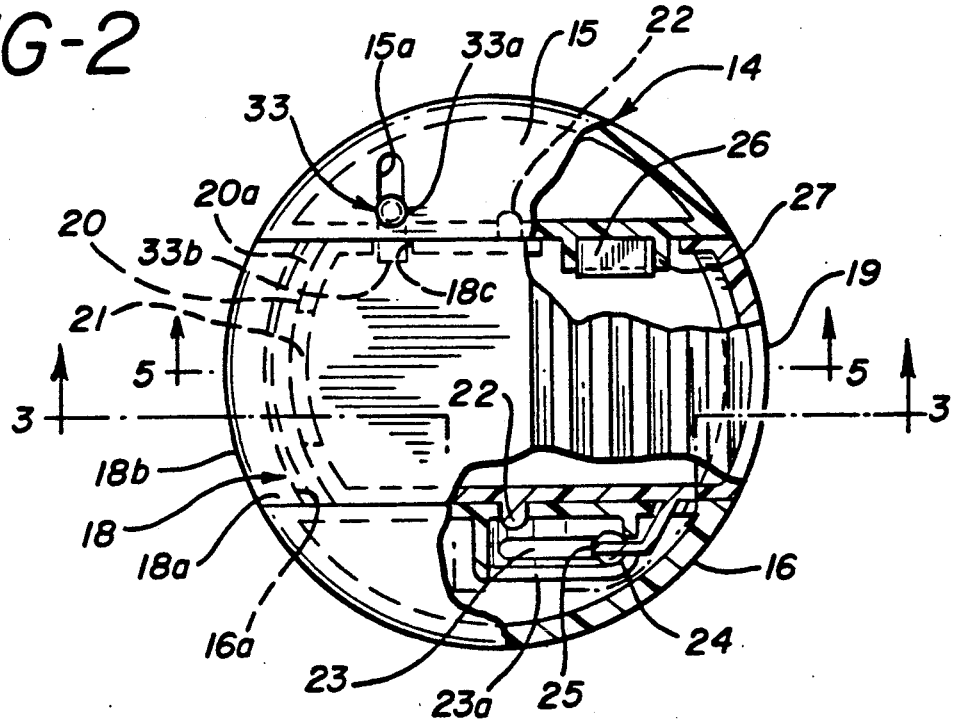
FIG. 2 is a top plan view of the cap shown in FIG. 1, part broken away and part in phantom to illustrate further details thereof.
Figure 3:
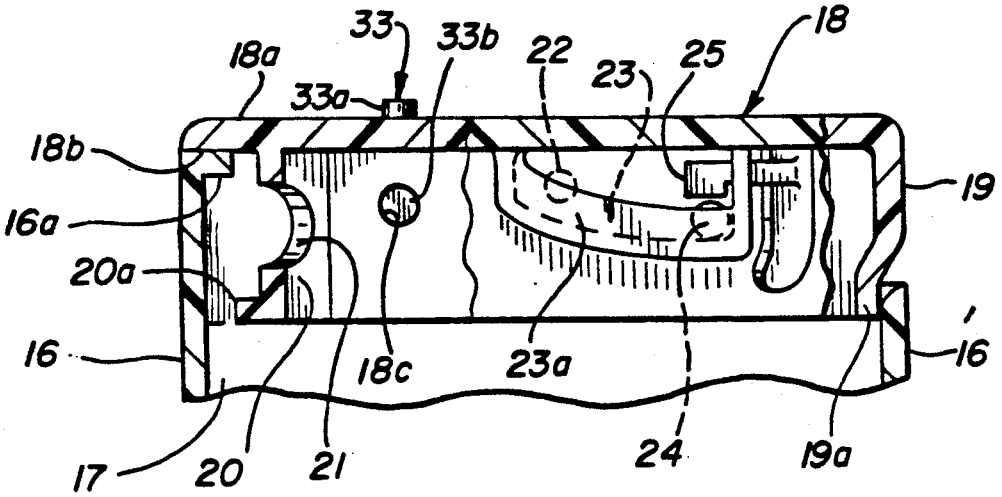
FIG. 3 is a view taken substantially on the line 3—3 of FIG. 2 and includes a fragmentary portion of the container.

Turning now to the drawing, there is shown in FIG. 1 the child resistant cap and container assemblage of the invention comprising a hollow cylindrical container body 10 with a closed lower end 11 and a neck portion 12 at its open upper end 13. After the container body 10 has been filled with unit doses of medication, a circular, hollow cap member 14 is secured to the container body 10 at its neck 12 in such a manner as to prevent normal, manual removal of the cap member 14 from the container body 10 as described in more detail hereinbelow. Cap number 14 has a circular upper planar surface 15 and a circumferential wall 16 depending from the upper surface 15 to define an open lower end 17 which communicates with open upper end 13 of container body 10.

Figure 4:
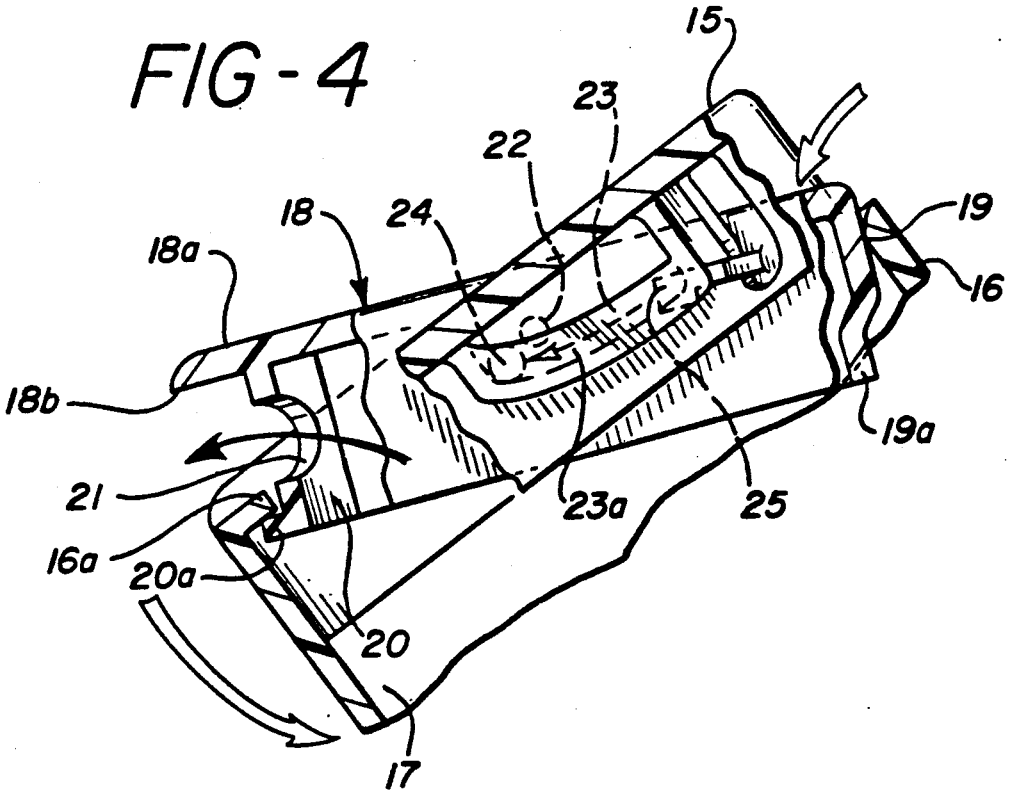
FIG. 4 is a view showing the cap and container assemblage of FIG. 3 tilted to its operative position.

As can be seen more clearly in FIGS. 2–4 and 7, cap member 14 is provided with a nozzle member 18 which is formed so that it extends across the diameter of the cap member 14 with the upper planar surface of the nozzle member 18 co-extensive with the upper planar surface 15 of the cap member 14. Nozzle member 18 has a depending back wall 19 that is substantially co-extensive with the circumferential wall 16 of cap member 14, the lower end **19*a* of back wall 19 terminating within the circumferential wall 16. The front wall 20 of nozzle member 18 also depends downwardly but is spaced inwardly from the circumferential wall 16 of the cap member 14 to define a nozzle lip area 18*a* whose edge 18*b* rests upon the upper edge of circumferential wall 16. The upper edge of circumferential wall 16 that lies beneath and is common with lip area 18*a* has an inwardly extending flange 16*a* and the lower end of front wall 20 terminates in a forwardly projecting leg 20*a* that engages flange 16*a* when nozzle member 18 is in its opened position (FIG. 4). An aperture 21 is formed intermediate the ends of front wall 20 to enable a unit dose of medication to be removed from the container body 10 when the nozzle member 18** is in its opened position.

Nozzle member 18 is hingeably secured to cap member 14 by any suitable hinging means, such as indicated by hinge pin 22, positioned intermediate the front wall 20 and back wall 19 enabling nozzle member 18 to be rotated about the hinge means to its opened position.

A baffle chamber 23 is formed in cap member 14 by means of a baffle wall 23*a* that extends angularly downward toward back wall 19 to contain a ball bearing 24. A downwardly extending post member 25 is provided in nozzle member 18 spaced from and substantially parallel to back wall 19 so that post member 25 is positioned over ball bearing 24 when the container 10 is in its normal upright position. Thus any attempt to rotate nozzle member 18 when the container 10 is in its normal, upright position will be prevented by the post 25 engaging the ball bearing 24.

Figure 5:
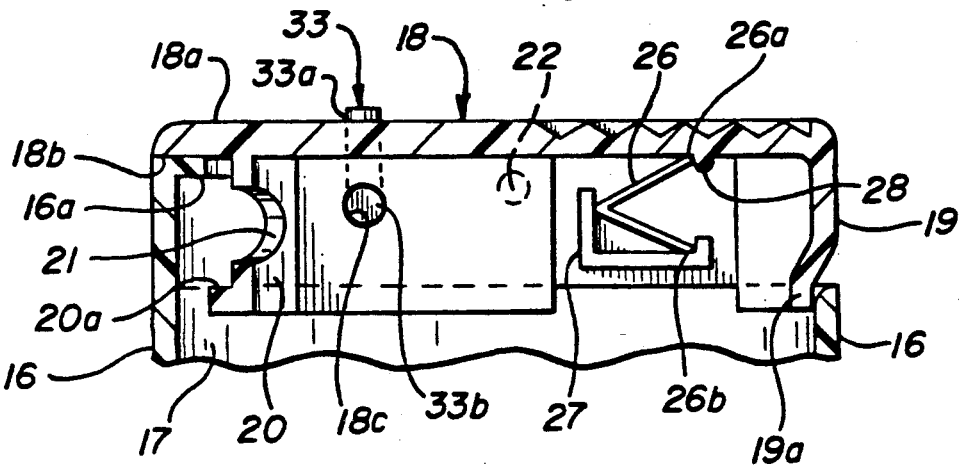
FIG. 5 is a view taken substantially on the line 5—5 of FIG. 2 and includes a fragmentary portion of the container.
Figure 7:
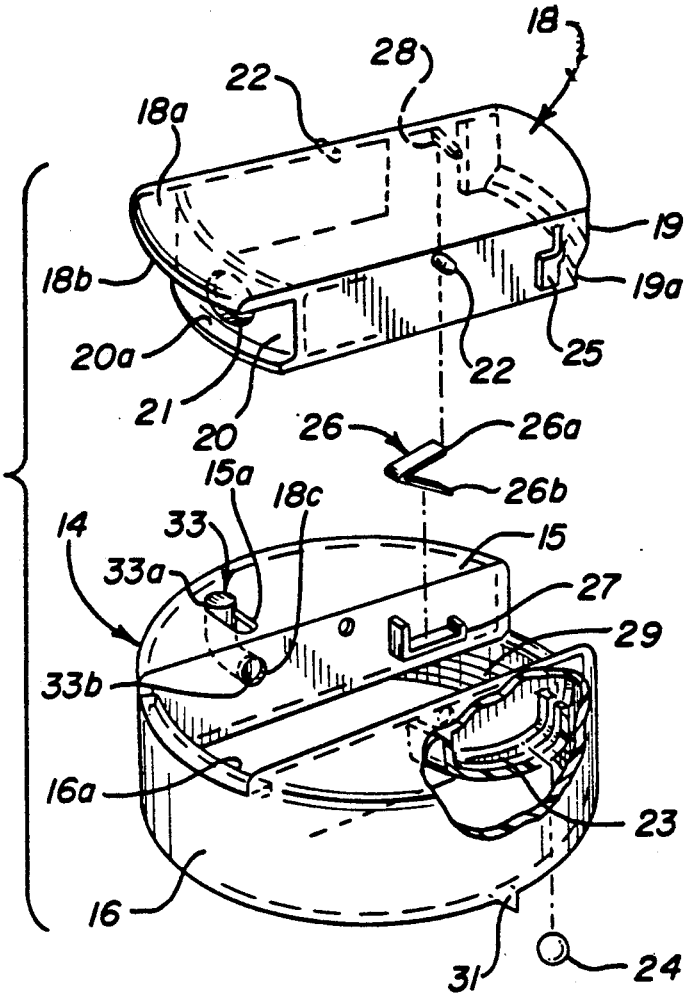
FIG. 7 is an exploded perspective view of the cap components.
Figure 8:
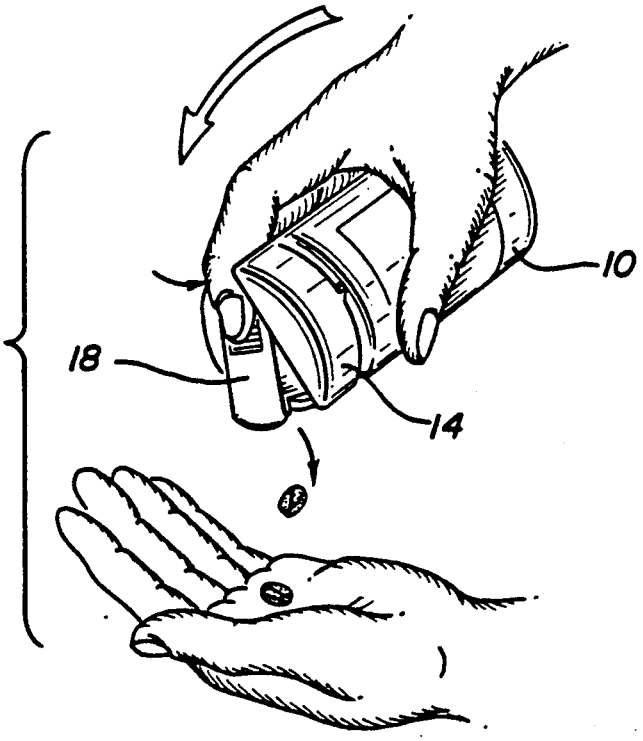
FIG. 8 is a perspective illustration of how a user would access the contents of the container using only one hand.

Nozzle member 18 can be retained in a normally closed position by a suitable spring means provided adjacent the baffle chamber 23. Details of one such spring means that can be used is illustrated in FIGS. 5 and 7 in the form of an angled leaf spring 26 which is retained within cap member 14 by U-shaped wall 27. A depending nodule 28 spaced from back wall 19 is provided to engage one end 26*a* of leaf spring 26 while the other end 26*b* of leaf spring 26 is retained within U-shaped wall 27. By this arrangement, leaf spring 26 is constantly biased against nozzle member 18 to keep nozzle member 18 in a normally closed position, the other end of nozzle member 18 being prevented from rotating by the engagement of lip area 18*a* with upper edge of circumferential cap wall 16.

Figure 6:
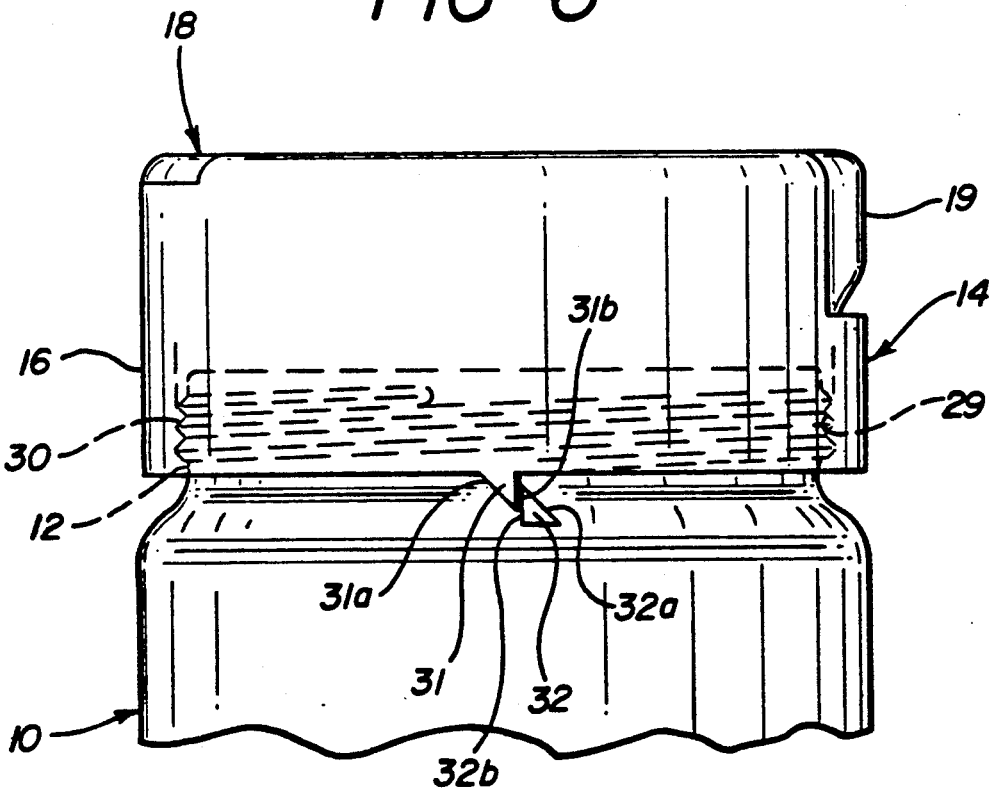
FIG. 6 is a view taken substantially on the line 6—6 of FIG. 1 illustrating one means by which the cap can be unremovably secured to the container.

After the container 10 has been filled with unit doses of medication, cap member 14 is secured to it in such a manner as to prevent its removal. One means for accomplishing this is illustrated in FIG. 6 where cap member 14 is provided with internal threads 29 that engage external threads 30 on the neck 12 of container 10 enabling cap 14 to be screwed onto container 10. To prevent cap 14 from being unscrewed and removed from container 10, the lower edge of cap 14 is provided with a depending tooth 31 and the shoulder 12*a* of neck 12 is provided with a stopper member 32.

When cap 14 is screwed onto container 10 in a clockwise direction, the leading edges of tooth 31 and stopper 32 can be beveled or tapered as indicated at 31*a* and 32*a*, respectively, to enable tooth 31 to travel past stopper 32 when cap 14 is screwed onto container 10. The trailing edges of tooth 31 and stopper 32 are perpendicular as indicated at 31*b* and 32*b*, respectively, so that they will firmly engage one another and prevent cap 14 from being unscrewed (i.e., rotated counter clockwise) and removed from container 10.

Cap 14 can also be secured to container 10 to provide an integral, unitary container by using conventional shrink wrapping techniques. These techniques typically use a heat shrinkable plastic band 34 such as polyethylene, polypropylene, and the like, which is placed around the container so that it overlaps a portion of the circumferential wall 16 of cap member 14 and the container body 10, as illustrated in FIG. 6. The band is then subjected to heat until it shrinks and contracts about the cap 14 and the container 10 in a tight fitting relationship. In order to remove cap 14 from container 10, the contracted plastic band would have to be broken and removed which would clearly indicate evidence of tampering.

Since cap 14 is secured to container 10 so that it can not be removed, the medication units in the container can be accessed by a user only through nozzle member 18.

As an added safety precaution, nozzle number 18 can also be equipped with a secondary lock means which must be disengaged before accessing medication units in the container 10. One type of secondary lock means that can be used is illustrated in FIGS. 1 2, 5 and 7 in the form of an L-shaped pin 33 seated in cap 14 so that its short leg 33*a* protrudes above surface 15. To seat pin 33 in cap 14, short leg 33*a* is provided with an annular groove intermediate its ends (not shown) that mates with a slot 15*a* formed in surface 15. An elongated slot 18*c* is formed in nozzle member 18 to receive the long leg 33*b* of L-shaped pin. L-shaped pin 33 seated can engage and disengage nozzle member 18 by sliding long leg 33*b* into and out of elongate slot 18*c*.

In order for a user to access the medication in the container, the user would slideably disengage L-shaped pin 33 from elongated slot 33*b*, tilt the container so that ball bearing 24 rolls in baffle chamber 23 away from its at rest position under post 25 (FIG. 4), depress nozzle 18 to expose aperature 20 and shake out the required or desired units of medication as illustrated in FIG. 7. After the medication units have been removed, the user releases downward pressure on nozzle 18 which automatically closes under the bias action of angled leaf spring 26 and then slideably re-engages L-shaped pin 33 into elongated slot 33*b*.

Thus, the cap and child resistant-container of the invention permits a user to quickly and easily access medication with one hand. Since the cap can not be removed from the container, it can not be lost or dropped and the container can not be left opened for extended periods of time so that the integrity of the medication in the container is not compromised.

Although the child resistant cap and container assemblage of the invention has been described with particularity and in some detail, it should be understood that modifications can be made therein without departing from the scope of the invention defined in the claims.

What is claimed is:

1. A child resistant cap and container assemblage being in a normally upright position during non-use comprising:

(a) a container body having a closed lower end and an open upper end;

(b) a cap member;

(c) means to secure said cap member to said container body such that said cap member cannot be normally removed from said container body so as to form an integral, unitary article;

(d) a nozzle member hingeably secured to said cap member;

(e) spring means within said cap member to maintain said nozzle member in a normally closed position; and (f) locking means within said cap member to engage said nozzle member and prevent it from being rotated when said assemblage is in its normally upright position.

2. The assemblage of claim 1 wherein:

(a) said cap member has a circular upper planar surface and a circumferential wall depending from said upper planar surface defining an open lower end that communicates with the open upper end of said container body;

(b) said nozzle member extends across the diameter of said cap member, said nozzle member having a depending back wall with a lower end, said lower end terminating within the circumferential wall of said cap member and a depending, opposed front wall spaced inwardly from the circumferential wall of said cap member to define a nozzle lip that extends to and overlies a portion of an upper edge of said circumferential wall, said front wall bordered by ends and having an aperture formed therein intermediate said ends; and, (c) said locking means comprises (i) a baffle chamber integrally formed within said cap member;

(ii) a ball bearing housed within said baffle chamber; and, (iii) a post member depending downwardly from an inner, lower surface of said nozzle member, said post member spaced inwardly from and substantially parallel to the back wall of said nozzle member and positioned to engage said ball bearing when said nozzle member is rotated and said assemblage is in its normally upright position.

3. The assemblage of claim 2 wherein a portion of the upper edge of said circumferential wall underlies said nozzle lip and has an inwardly extending flange, and a lower end of the front wall of said nozzle member terminating in a forwardly projecting leg that engages said inwardly extending flange to arrest rotation of said nozzle member when said assemblage is tilted and said nozzle member is rotated.

4. The assemblage of claim 2 wherein said spring means is an angled leaf spring retained within said cap member and is biased to constantly urge upwardly one end of said nozzle member which is adjacent to said back wall of said nozzle member.

5. The assemblage of claim 2 wherein said securing means comprise:

(a) internal threads in said cap member which threadably engage external threads at the open upper end of said container body;

(b) a tooth depending from a lower edge of the circumferential wall of said cap member; and, (c) a stopper member on said container body adjacent its open upper end positioned to engage said tooth and prevent said cap member from being removed.

6. The assemblage of claim 1 wherein said securing means comprises a plastic film securely heat shrunk about the juncture of said cap member and said container body containing said cap member and said container body therewithin in a tight fitting relationship.

* * * * *